US006317100B1

(12) United States Patent
Elson et al.

(10) Patent No.: US 6,317,100 B1
(45) Date of Patent: Nov. 13, 2001

(54) PLANAR ANTENNA ARRAY WITH PARASITIC ELEMENTS PROVIDING MULTIPLE BEAMS OF VARYING WIDTHS

(75) Inventors: J. Todd Elson, Bellevue; Ray K. Butler, Woodinville; Douglas O. Reudink, Kirkland; Todd Achilles, Seattle, all of WA (US)

(73) Assignee: Metawave Communications Corporation, Redmond, WA (US)

( * ) Notice: Subject to any disclaimer, the term of this patent is extended or adjusted under 35 U.S.C. 154(b) by 0 days.

(21) Appl. No.: 09/351,276

(22) Filed: Jul. 12, 1999

(51) Int. Cl.[7] ..... H01Q 21/00
(52) U.S. Cl. ..... 343/853; 343/833; 343/893
(58) Field of Search ..... 343/853, 793, 343/818, 833, 834, 835, 815, 893, 817, 819

(56) References Cited

U.S. PATENT DOCUMENTS 4,700,197 * 10/1987 Milne ..... 343/837
4,772,890 * 9/1988 Bowen et al. ..... 343/853
5,189,433 * 2/1993 Stern et al. ..... 343/853
5,214,436 * 5/1993 Hannan ..... 343/893
5,589,843 * 12/1996 Meredith et al. ..... 343/820
5,877,726 * 3/1999 Kudoh et al. ..... 343/853
5,929,823 * 7/1999 Martek et al. ..... 343/853
5,936,591 * 8/1999 Yamasa et al. ..... 343/853
6,070,090 * 5/2000 Feuerstein ..... 455/561
6,094,166 * 7/2000 Martek et al. ..... 343/893

* cited by examiner

*Primary Examiner*—Don Wong
*Assistant Examiner*—Thuy Vinh Tran
(74) *Attorney, Agent, or Firm*—Fulbright & Jaworski L.L.P.

(57) ABSTRACT

An antenna system adapted to provide antenna beams having various characteristics, such as various beam widths and/or different orientations, is disclosed. In a preferred embodiment, the antenna system is adapted to provide forward link signals in wide antenna beams while providing reverse link signals in narrow antenna beams. In the preferred embodiment multiple forward link wide beams are provided to allow uniform radiation of forward link signals throughout a desired area, such as a sector of a cell, while multiple non-overlapping narrow antenna beams are provided in the reverse link. In the preferred embodiment passive or parasitic antenna elements are utilized in the antenna array to provide symmetric current distribution in the antenna array to provide multiple beams having uniform characteristics.

53 Claims, 3 Drawing Sheets

PLANAR ANTENNA ARRAY WITH PARASITIC ELEMENTS PROVIDING MULTIPLE BEAMS OF VARYING WIDTHS

RELATED APPLICATIONS

The present invention is related to co-pending and commonly assigned U.S. patent applications Ser. No. 08/896,036, entitled "Multiple Beam Planar Antenna Array with Parasitic Elements," filed Jul. 17, 1997, now U.S. Pat. No. 5,929,823, and Ser. No. 09/034,471, entitled "System and Method for Per Beam Elevation Scanning," filed Mar. 4, 1998, the disclosures of which are incorporated herein by reference.

TECHNICAL FIELD

This invention relates to multiple beam array antennas, and, more particularly, to multiple beam antennas adapted to provide radiation patterns of various widths.

BACKGROUND

Often in wireless communications, such as cellular or personal communication services (PCS), remote units are limited in power, such as may result from the use of battery operated hand-held radio units. Accordingly, although a centralized communication array, such as a base transceiver station (BTS) providing network communication to a plurality of remote units, may possess sufficient power resources to provide a desired signal level throughout a service area in a forward link, the remote units may not be capable of providing a reverse link signal which matches the power of the forward link. Similarly, prudent use of resources may suggest conserving energy by the remote units, thus dictating a reverse link signal which does not match the power of the forward link. Accordingly, the use of high gain antenna beams, such as those provided by a directional narrow beam system, is often very desirable. Moreover, in addition to increased gain, such narrow beams allow a receiver to isolate the signal of interest from sources of interference which are sourced outside of the narrow beam.

The use of narrow antenna beams provides increases in gain over that of a wider antenna beam, although such narrow beams, by definition, do not provide communication within as large of an area as the more broad antenna beam. Accordingly, multiple and/or steerable narrow antenna beams are often used in order to direct a beam to a portion of a larger service area which includes a remote unit desiring communication services. By selectively directing the narrow antenna beams used in the reverse link a high gain antenna beam may be utilized to provide communication with a remote unit. Where multiple communication channels are used, such narrow beams are useful in the reverse link, for example, to selectively couple only those antenna beams having a channel of interest appearing therein to the appropriate radio receivers.

However, narrow antenna beams may not always be preferred in providing desired communication services. For example, the use of narrow antenna beams by definition limits the area in which communications may be conducted and, therefore, it may be advantageous to provide a signal in a wider area so as to increase the area in which communications may be conducted.

The above described directional or steerable antenna beams are often produced by a linear planar array of antenna elements. The antenna beams are formed by exciting the antenna elements, often disposed in vertical columns, by a signal having a predetermined phase differential so as to produce a composite radiation pattern combined in free space to have a predefined shape and direction, wherein the fewer such antenna elements excited by the signals having the predetermined phase differential the more broad the beam resulting therefrom. In order to steer this composite beam, the phase differential between the antenna elements, or columns, is adjusted to affect the composite radiation pattern. A multiple beam antenna array may be created through the use of predetermined sets of phase differentials, where each set of phase differential defines a beam of the multiple beam antenna. There are a number of methods of beam steering using matrix type beam forming networks, such as a Butler matrix, or adaptive circuitry that can be made to adjust parameters, such as, for example, might be directed from a computer algorithm. This latter circuitry is the basis for adaptive arrays.

These planar arrays of antenna elements and their associated signal feed networks, although typically well suited for providing a particular antenna beam width for which they are designed, generally do not provide various beam widths. For example, a planar array adapted to provide multiple narrow antenna beams will have an number of elements and element placement, including inter-element spacing, optimized for producing these multiple narrow antenna beams, as well as a feed network adapted to provide the proper phase progression at these antenna elements. Accordingly, if a wider antenna beam is desired, such as may be produced by energizing a smaller number of the antenna elements, the antenna element placement and/or spacing may not result in a formed antenna beam of desired shape. For example, if a single antenna element column is to be excited to provide a wide antenna beam, this single antenna column as it is disposed in the multiple beam planar array may provide an antenna beam of less than a desired width and/or be ladened with high order side lobes, nulls, and the like. Moreover, as the antenna elements of such an array are optimized for a particular antenna beam width, energizing different subsets of the antenna elements or columns will result in inconsistent formation of the alternate width antenna beams.

Accordingly, where multiple channels are to be broadcast throughout a wide area, whether via a single wide beam antenna or contiguous narrow antenna beams, such signals must be combined for transmission within the beam(s) covering the area to be serviced. This is because if multiple narrow beams are used to provide the channels throughout a wider service area, each channel is combined in the narrow antenna beams covering a portion of the desired service area. Where a wider beam produced from a typical prior art multiple narrow beam antenna array is used to provide coverage of the desired service area, in order to avoid the multiple channels having different coverage areas due to the inconsistent formation of the alternate width antenna beams, multiple amplifiers are combined for energizing a common subset of antenna elements.

However, combiners, such as auto-tune, or cavity, combiners providing summing of high power signals for transmission are often very lossy, such as on the order of 4 to 5 dB. Therefore, although it might be desirable to provide forward link signals in a wide service area, since power in the forward link is often sufficient to give a desired signal level throughout such an increased portion of the service area, reasons such as the need for narrow antenna beams in the reverse link and signal loss due to combining such signals for transmission often discourage the use of such wide antenna beams.

Accordingly, a need exists in the art for an antenna system which allows for the provision of differing antenna beam widths in both the forward and reverse links. Moreover, a need exists in the art for such a system to provide multiple channels within desired service areas using the differing antenna beam widths efficiently and without introducing substantial signal loss.

SUMMARY OF THE INVENTION

These and other objects, features and technical advantages are achieved by a system and method in which an antenna array design utilizes parasitic elements placed at predetermined locations to provide consistent and desired antenna beam formation providing various antenna beam widths in the forward and reverse links. The use of parasitic elements of the present invention has the desired characteristic of providing directional, relatively narrow beams, such as may be desirable for use in the reverse link, having substantially uniform beam widths and desired azimuthal orientation. Likewise, the use of parasitic elements of the present invention has the desired characteristic of providing directional relatively wide beams, such as may be desirable for use in the forward link, having substantially uniform beam widths and orientation.

In the preferred embodiment of the present invention, parasitic elements are placed in the same plane as the active antenna elements of the planar antenna array. Preferably, the parasitic elements are disposed in a configuration consistent with that of the driven elements. Specifically, in a planar array including a plurality of columns of driven antenna elements, the parasitic elements are also placed in columns, wherein the inter-column element spacing of the parasitic elements is consistent with that of the driven elements and/or the column spacing is consistent with that of the driven antenna element columns.

In a preferred embodiment of the present invention, a sufficient number of parasitic antenna elements are disposed in the same plane as the active antenna elements to result in the current distribution on the antenna to be substantially symmetric when desired numbers of elements are energized. For example, where four active antenna element columns are adapted to provide directional narrow antenna beams, four columns of parasitic antenna elements of a preferred embodiment are added in the plane of the active elements, wherein two columns of these parasitic elements are disposed each along a left and a right edge of the four active antenna element columns. Accordingly, in this preferred embodiment, an otherwise edge active antenna element column includes multiple columns of parasitic antenna element columns to one side and multiple columns of active antenna element columns to the opposite side.

Accordingly, a technical advantage of the present invention is to use strategically placed parasitic elements in addition to the active elements of an antenna array to produce a composite radiation pattern having desired attributes.

A further technical advantage of the present invention is to provide parasitic antenna elements disposed to provide substantially symmetric current distribution on the antenna and, thereby, substantially antenna patterns. Accordingly, a still further technical advantage of the present invention is to utilize parasitic elements to result in improved beam symmetry even when utilizing subsets of the active antenna elements to provide various beam widths.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWING

For a more complete understanding of the present invention, and the advantages thereof, reference is now made to the following descriptions taken in conjunction with the accompanying drawing, in which.

DETAILED DESCRIPTION

Figure 1:
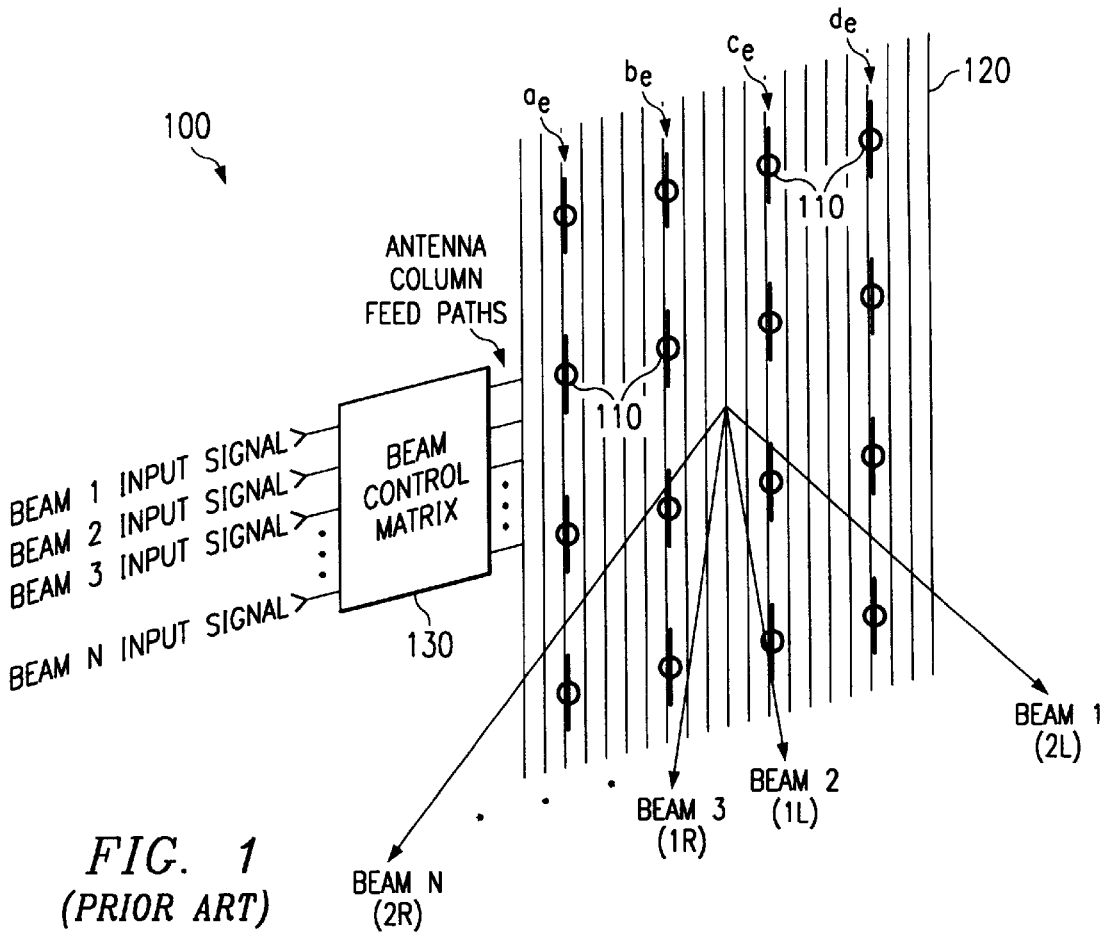
FIG. 1 (PRIOR ART)
FIG. 1 shows a typical prior art multiple beam planar array.

A typical prior art planar array suitable for producing steerable beams is illustrated in FIG. 1 as antenna array 100. Antenna array 100 is composed of individual antenna elements 110 arranged in a predetermined pattern, here forming four columns $a_e$ through $d_e$, of four elements each. These antenna elements are disposed a predetermined fraction of a wavelength ($\lambda$) in front of ground plane 120. It shall be appreciated that energy radiated from antenna elements 110 will be reflected from ground plane 120, summing to form a radiation pattern having a wave front propagating in a predetermined direction. This predetermined direction may be adjusted through the use of beam forming, including adaptive beam forming, techniques such as introducing a phase differential in the signal between each radiator column $a_e$, through $d_e$.

Antenna array 100 has coupled thereto beam control matrix 130. Beam control matrix 130 provides circuitry to accept an input signal and provide it to the various columns of antenna array 100, applying the aforementioned beam forming technique, such that beams having wave fronts propagating in different directions may be formed. For example, each of the beams 1 through N as illustrated may be formed by beam control matrix 130 properly applying an input signal to antenna columns $a_e$ through $d_e$. Where four such beams are formed (i.e., N=4), these beams are commonly referred to from right to left as beams 2L, 1L, 1R, and 2R corresponding to beams 1 through N of FIG. 1.

Beam control matrices, such as a Butler matrix, are well known in the art. These matrices typically provide for various relative phase delays to be introduced in the signal provided to various columns of the antenna array, thereby providing a desired phase progression, such that the radiation patterns of each column sum to result in a composite radiation pattern having a primary lobe propagating in a predetermined direction.

These composite radiation patterns may be azimuthally steered from the broadside. For example, beam 2L (beam 1 of FIG. 1) may be steered 45° from the broadside direction through the introduction of an increasing phase lag (Δ, where Δ<0) between the signals provided to columns $a_e$ through $d_e$. Assuming that the horizontal spacing between each of the columns $a_e$ through $d_e$ is the same, beam 2R may be created by providing column $a_e$ with the input signal in phase, column $b_e$ with the input signal phase retarded Δ, column $c_e$ with the input signal phase retarded 2Δ, and column $d_e$ with the input signal phase retarded 3Δ. Of course the exact value of Δ depends on the spacing between the columns.

Similarly, beam 1L (beam 2 of FIG. 1) may be 15° from the broadside direction through the introduction of a phase lag between the signals provided to the columns. Here, however, the phase differential need not be as great as with beam 2R above as the deflection from broadside is not as great. For example, beam 1R may be created by providing column $a_e$ with the input signal in phase, column $b_e$ with the input signal phase retarded ⅓Δ, column $c_e$ with the input signal phase retarded ⅔Δ (2*⅓Δ), and column $d_e$ with the input signal phase retarded Δ (3*⅓Δ).

Figure 2:
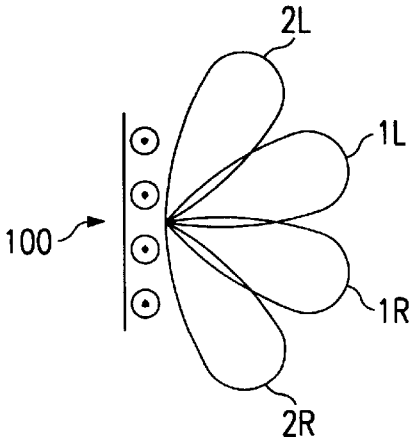
FIG. 2 shows substantially non-overlapping narrow antenna beams as may be provided by a planar array.

Beam control matrix 130 may be adapted to provide predetermined antenna beams to thereby establish wireless communications within a desired service area. For example, directing attention to FIG. 2, antenna beams 2L, 1L, 1R, and 2R of antenna array 100 as formed by beam control matrix 130 may be substantially non-overlapping antenna beams of approximately 30° width. FIG. 2 shows an estimated azimuth far-field radiation pattern using the method of moments with respect to the antenna array shown in FIG. 1.

The use of such relatively narrow antenna beams provides increases in gain over that of a more broad antenna beam, although such narrow beams, by definition, do not provide communication within as large of an area as the more broad antenna beam. Accordingly, multiple such narrow antenna beams are often directed, as shown in FIG. 2, in order to allow each to cover a portion of a larger service area with increased gain over that of a single antenna beam covering the same area.

Although a centralized communication array, such as a base transceiver station (BTS) providing network communication to a plurality of remote units, may possess sufficient power resources to provide a desired signal level throughout a service area in a forward link, the remote units may not be capable of providing a reverse link signal which matches the power of the forward link. Similarly, prudent use of resources may suggest conserving energy by the remote units, thus dictating a reverse link signal which does not match the power of the forward link. Accordingly, the use of high gain narrow antenna beams, such as those provided by antenna array 100, is often very desirable. Moreover, in addition to increased gain, such narrow beams allow a receiver to isolate the signal of interest from sources of interference which are sourced outside of the narrow beam. Where multiple communication channels are used, such narrow beams are useful in the reverse link, for example, to selectively couple only those antenna beams having a channel of interest appearing therein to the appropriate radio receivers.

However, narrow antenna beams may not always be preferred in providing desired communication services. For example, the use of narrow antenna beams by definition limits the area in which communications may be conducted and, therefore, it may be advantageous to provide a signal in a wider area so as to increase the area in which communications may be conducted.

It shall be appreciated that the width of the antenna beams formed by antenna array 100 are determined in part by the number of antenna element columns energized with a particular phase progression. Specifically, the beam width is inversely proportional to the number of antenna element columns energized. Accordingly, energizing all four antenna element columns of antenna array 100 will produce a more narrow antenna beam than energizing any subset of antenna element columns, such as one or two antenna element columns.

Figure 3:
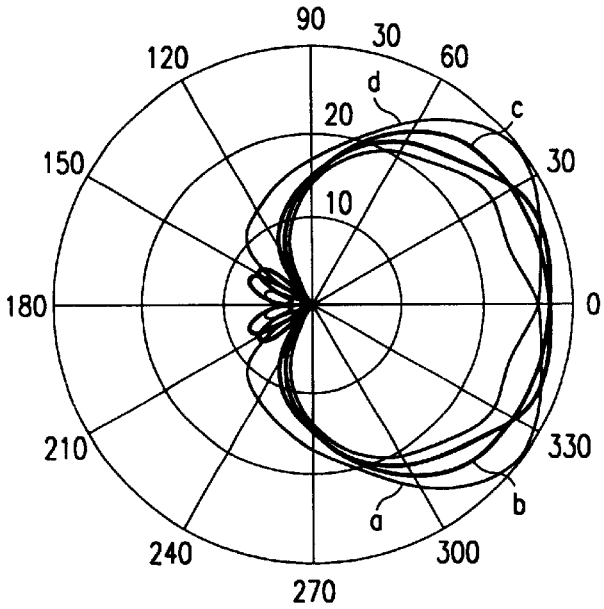
FIG. 3 shows antenna beams formed as a result of energizing each antenna element column of FIG. 1 separately and independently.

However, the configuration of antenna array 100 is specifically adapted for forming particular sized antenna beams, such as the aforementioned approximately 30° beams. Attributes such as antenna element column spacing, number of antenna element columns, and the like are optimized for these particular sized antenna beams. Accordingly, use of this antenna array in forming alternative beam widths results in undesirable beam characteristics. For example, FIG. 3 shows the azimuthal far field radiation patterns, beams a, b, c, and d, associated with energizing antenna element columns a, b, c, and d of antenna array 100 separately and independently. Energizing a single antenna element column of antenna array 100 provides beam widths substantially larger than those of FIG. 2, where all four antenna element columns are energized in forming approximately 30° beams. However, as shown in FIG. 3, these wide beams are not uniform in beam width or coverage area and are asymmetrical. Specifically, driving an outer column yields a much different pattern than driving an inner column. The large inconsistency causes differing coverage areas for signals provided to the different columns. Moreover, the patterns for the outer column excitation points approximately 30° away from the broadside direction. Additionally, the beam widths provided by this single column excitation (the widest beam widths possible with the antenna array of FIG. 1, are too narrow to provide sufficient sector coverage in a typical cellular or PCS communication system, for example.

Accordingly, if such an antenna array were adapted to energize a single antenna element column in forming a wide antenna beam, a selected antenna element column would be required to be used at all times in order to avoid providing inconsistent wide antenna beams, i.e., if column $a_e$ were used at one epoch or for one signal and column $b_e$ were used at another epoch or for another signal, the area in which the signals are provided would not be consistent from epoch to epoch or signal to signal. Therefore, where multiple channels are to be provided within a relatively wide service area, these channels would require combining for radiation by antenna array 100 in order to provide the channels consistently in the service area.

For example, typical IS-136 TDMA base stations operating at PCS frequencies include up to eight channels per sector. The usual method of transmitting these eight channels in a sector is to amplify each channel separately and combine the amplified signals in a cavity combiner for transmission in an antenna beam providing sector coverage. However, combiners, such as auto-tune, or cavity-combiners providing summing of high power signals for transmission are often very lossy, such as on the order of 4 to 5 dB. Therefore, although it may be desirable to provide forward link signals in a wide service area as described above, an antenna array optimized for narrow antenna beams, such as antenna array 100, are generally not suitable for such a purpose.

In a preferred embodiment of the present invention parasitic elements are added to an antenna array to adapt the antenna array for forming desired alternate width antenna beams. These parasitic elements are disposed in the same plane as the active antenna elements, preferably symmetrically at the edge of the active antenna element array.

Figure 4A:
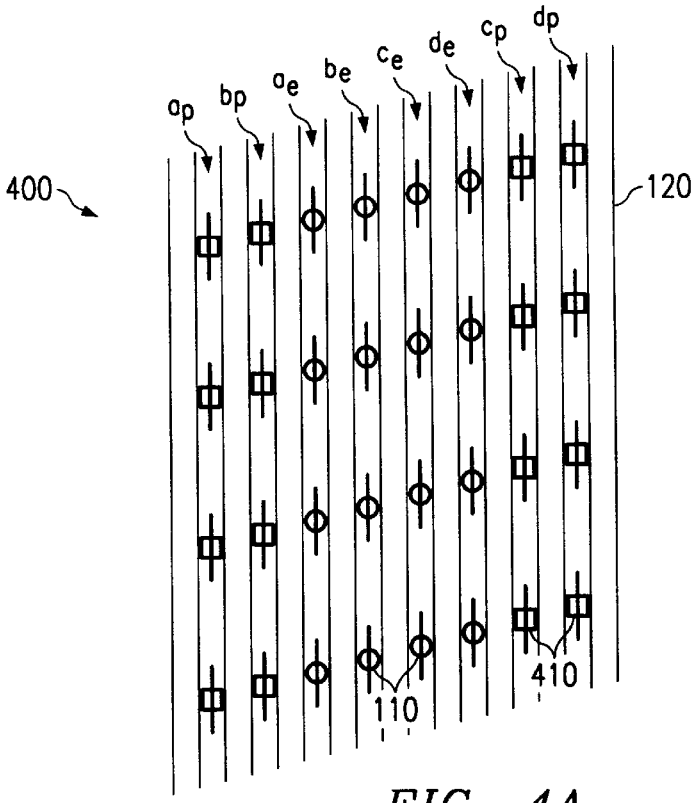
FIGS. 4A and 4B show a planar array adapted according to a preferred embodiment of the present invention.
Figure 4B:
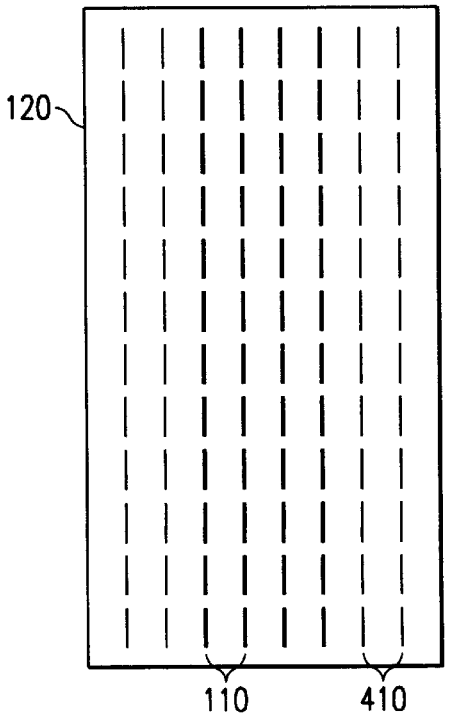

Directing attention to FIG. 4A, a planar array including parasitic elements 410 of the present invention, arranged in columns $a_p$ through $d_p$ located in the same plane as active elements 110 of the antenna array, is shown. It shall be appreciated that the active elements of the present invention are arranged substantially as illustrated in FIG. 1. Of course, an antenna array including a different number and/or arrangement of active elements may be used, if desired. For example, FIG. 4B illustrates an antenna array adapted according to the present invention including an increased number of antenna elements in each antenna element column.

In the preferred embodiment, where the antenna array is to provide narrow antenna beams associated with energizing all antenna element columns and wide antenna beams associated with energizing a single antenna element column. The parasitic elements of the present invention are the same size as the active elements of the planar array,. For example, where the active elements are ½λ, the parasitic elements would also be ½λ according to the preferred embodiment of the present invention. Of course, any length of parasitic element determined to adapt the antenna array for providing various desired antenna beam widths and attributes may be used, if desired.

Referring again to the preferred embodiment of FIG. 4A, it can be seen that in the preferred embodiment the individual parasitic elements are placed vertically within columns $a_p$ through $d_p$, divided equally for disposition at the left and right edges of antenna array 100. The antenna element column spacing, as well as the inter-column antenna element spacing, substantially corresponds to the active elements of radiator columns $a_e$ through $d_e$.

Figure 5:
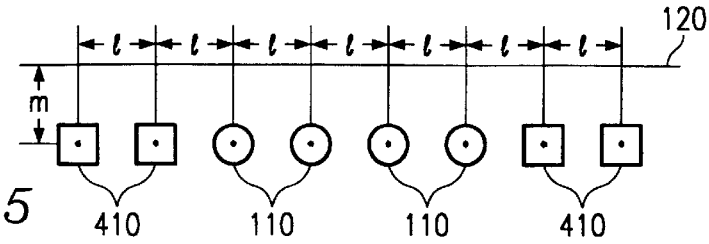
FIG. 5 shows a top view of the antenna array of FIG. 4A.

As shown in a preferred embodiment top view of FIG. 5, the antenna element column spacing is preferably substantially the same distance l, which in a preferred embodiment is ¼λ. The top view of FIG. 5 more clearly illustrates the placement of the parasitic elements 410, with respect to active elements 110 and ground plane 120. Specifically, the parasitic elements of this preferred embodiment of the present invention are, in addition to being located at a distance l from a next adjacent antenna element column, are located a distance m off of the ground plane, as are active antenna elements 110.

In a most preferred embodiment of the present invention the distance m is approximately ¼λ. However, the distance m may be any distance determined to provide the various desired antenna beam widths.

It should be appreciated that antenna element column spacing may be varied, such as where the ground surface 120 is irregular in shape. Likewise, it should be appreciated that the inter-column antenna element spacing may be varied, such as where a reduced in length column is desired, such as to produce aperture tapering, to accommodate elevation beam scanning, or the like. A preferred system and method for providing aperture tapering through reducing the spacing of antenna elements of a column and for providing elevation beam scanning are shown and described in the above referenced United States patent application entitled "System and Method for Per Beam Elevation Scanning."

The preferred embodiment arrangement of parasitic elements is specifically adapted to result in a highly symmetric current distribution in the antenna array even when energizing varying numbers of antenna element columns and, thus, provide highly symmetric antenna patterns of varying widths. In this regard, a sufficient number of parasitic antenna elements are preferably disposed in the same plane as the active antenna elements to result in the current distribution on the antenna to be substantially symmetric. For example, where four active antenna element columns are provided as illustrated in FIG. 4A, four columns of parasitic antenna elements of a preferred embodiment are added in the plane of the active elements, with two columns of these parasitic elements disposed along a left and a right edge of the four active antenna element columns. Accordingly, in this preferred embodiment, an otherwise edge active antenna element column includes multiple columns of parasitic antenna element columns to one side and multiple columns of active antenna element columns to the opposite side. The number of antenna elements disposed to either side of an energized antenna element column therefore will appear, electrically, to be substantially consistent (taking into consideration that as the antenna element columns are disposed further away from the energized antenna element column their affect becomes diminished in a geometric progression).

In alternative embodiments of the present invention, numbers of parasitic antenna element columns other than those of the preferred embodiment described above may be utilized. For example, where antenna element column spacing is great enough that multiple columns of antenna elements become electrically insignificant, e.g. $l>\lambda$, a single column of parasitic antenna elements at each edge may be utilized. Similarly, where antenna element column spacing is small enough that more than two columns of antenna elements become electrically significant, e.g. $l<\frac{1}{8}\lambda$, columns of parasitic antenna elements in addition to those shown in FIG. 4A may be used. However, computer modeling of the four column planar array of FIG. 4A confirms that parasitic antenna element columns placed outboard to those of the preferred embodiment, wherein $l\approx\frac{1}{4}\lambda$, have diminimus effect electrically, while introducing disadvantages, such as increasing costs, unnecessarily increasing antenna weight, size, and wind loading, and the like.

Another alternative embodiment of the present invention includes parasitic antenna element columns interleaved between ones of the columns of active antenna element columns, to provide antenna beam symmetry for various combinations of active antenna element columns utilized in forming the desired antenna beams.

Figure 6:
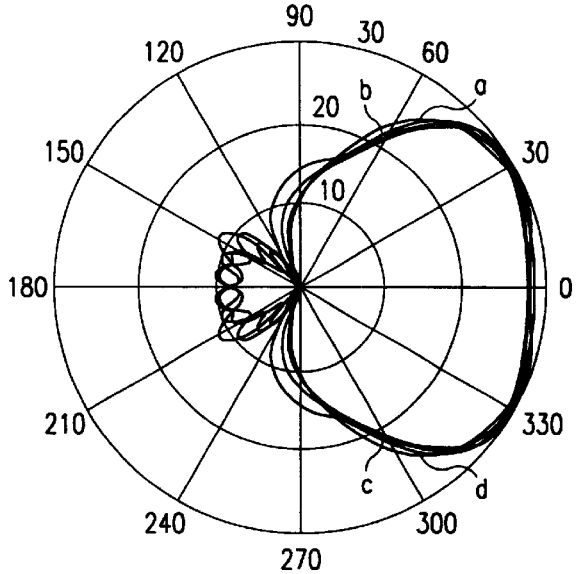
FIG. 6 shows antenna beams formed as a result of energizing each antenna element column of FIG. 4A separately and independently.

Directing attention to FIG. 6, an estimated azimuthal far-field radiation pattern using the method of moments with respect to the antenna array of FIG. 4A is shown. Here, as with the radiation pattern of FIG. 3, azimuthal far field radiation patterns, beams a, b, c, and d, associated with energizing antenna element columns a, b, c, and d of antenna array 400 separately and independently, are shown. However, as shown in FIG. 6, the wide beams provided by the antenna array of FIG. 4A are uniform in beam width and coverage area and are substantially symmetrical. Specifically the difference between any two beams of FIG. 6 at any angle within the 3 dB beam width of the beams is less than 1 dB. Moreover, these wide beams, in the embodiment illustrated in FIG. 6 approximately 100°, are well suited for use in providing cellular or PCS sector coverage, both because of the width of the beams and their shape.

Computer modeling indicates that the addition of the parasitic elements of FIG. 4A does not adversely affect the formation of the narrow antenna beams associated with a properly phased signal presented to each of the active antenna element columns, providing multiple narrow antenna beams as shown in FIG. 2. Accordingly, the antenna array of the present invention may be utilized to provide various desired beam widths, such as one beam width in the forward link and another in the reverse link, one beam width for one communication service using the array (digital PCS for example) and another beam width for a second communication service using the array (analogue cellular for example), or any other situation where various beam widths are desirable. Specifically, energizing a single active antenna element column, or coupling radio receiver to a single antenna element column, of antenna array 400 provides a wide beam, such that with each active column beam has substantially the same orientation and beam width to thereby provide communication within a predetermined area, such as a cellular BTS sector. However, where all four active antenna element columns are energized, or a radio receiver is coupled to all four active antenna element columns, through a beam forming circuit, such as a Butler matrix, multiple narrow beams are formed which may be directed in various orientations within a service area, such as the aforementioned cellular BTS sector.

Figure 7:
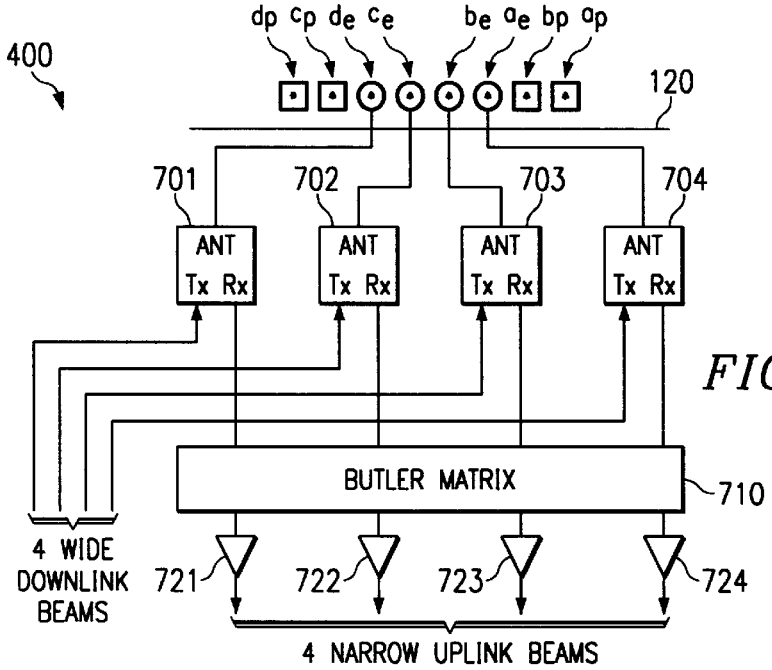
FIG. 7 shows a preferred embodiment signal feed network for use with the antenna array of FIG. 4A.

Circuitry adapted to provide wide beam widths in a forward link and narrow beam widths in the reverse link according to a preferred embodiment of the present invention is shown in FIG. 7. Here the signal feed paths of each of active antenna element columns $a_e$ through $d_e$ are coupled to an associated duplexer circuit, shown as duplexers 701–704. Accordingly, the antenna columns may be coupled to beam forming matrix 710, which may be adaptive array circuitry or a Butler matrix for example, in the reverse link (receive mode) to result in the formation of desired multiple directional and/or narrow receive antenna beams, while avoiding beam forming matrix 710 in the forward link (transmit mode) to allow the formation of transmit antenna beams substantially different than the receive antenna beams. For example, each of active antenna element columns $a_e$ through $d_e$ may be individually coupled to a transmitter to thereby provide the same sector coverage without introducing signal loss due to combining the transmitter signals for radiation. However, in the receive mode, multiple substantially non-overlapping narrow beams formed by beam forming matrix 710, each preferably provided through a low noise amplifier (LNA) such as LNAs 721–724, may be selected from for coupling of a particular beam or beams to a receiver in order to improve gain of a received signal, isolate a desired received signal from noise present outside particular beams, or the like.

In a preferred embodiment, the antenna array and associated signal feed circuitry described above is utilized in providing PCS communications in sectors of a cell. IS-136 TDMA BTSs operating at PCS frequencies have up to eight channels per sector, all of which may be radiated throughout the area of the sector by the present invention without introducing substantial signal losses associated with combining. As only four wide beams are provided by the circuitry of FIG. 7, some combining of the eight channels is necessary if all channels are to be simultaneously radiated. Accordingly, diplexers (not shown) well known in the art may be utilized, such as may be disposed in a BTS equipment shack, to combine the signals of two PCS channels for radiation in a same wide antenna beam. As each active antenna element column energized separately provides an antenna beam having substantially the same orientation and beam width as each of the other active antenna element columns, the use of a diplexer associated with each active antenna element column allows for the uniform radiation of all eight channels within a desired sector area.

It shall be appreciated that combining signals for radiation through the use of diplexers introduces signal loss on the order of less than 1 dB and, therefore, is typically an acceptable technique for transmission of signals. In contrast, if a system were used which did not provide multiple uniform antenna beams, thus requiring the use of a same antenna beam for all eight channels, an eight to one combiner, such as an auto-tune or cavity combiner would be required. Such a cavity combiner is very lossy, introducing losses on the order of 4–5 dB.

It shall be appreciated that the circuitry of FIG. 7 may be easily disposed at tower top. Accordingly, a preferred embodiment of the present invention may be utilized in providing an applique or retrofit antenna array which is adapted to couple to existing forward and reverse link signal paths to provide the advantages described herein.

Although a preferred embodiment has been shown wherein different beam widths are used in the forward and reverse links, it shall be appreciated that the present invention is not so limited. For example, by replacing duplexers 701–704 of FIG. 7 with signal combiners, such as Wilkinson combiners, the present invention may be utilized to provide two different communication services sharing antenna array 400 with different sized antenna beams.

Although a planar array adapted to provide four narrow beams having different predetermined angles of propagation and four wide beams having substantially the same orientation have been discussed herein, it shall be appreciated that the present invention is not limited to use in such a system. The aspects of the present invention described herein are equally useful in providing desired and uniform antenna beams of various beam widths of unlimited configurations.

It shall be appreciated that, although the present invention has been discussed with respect to the use of wide antenna beams in the forward link (transmission) and narrow antenna beams in the reverse link (reception), it is equally adaptable for use of narrow antenna beams in the forward link and wide antenna beams in the reverse link, if desired.

Furthermore, although the present invention has been described with reference to a planar array having four radiator columns, any configuration of active antenna elements may benefit by the parasitic elements of the present invention. In addition, the ground plane could be curved or folded and the same concepts would apply. Likewise, the number of antenna elements included in any radiator column of the present invention may be varied from that shown. Of course, variation in the number of radiator columns and/or antenna elements will benefit by a corresponding variation in the number of parasitic elements utilized by the present invention. It shall be appreciated that any number of active element configurations may be adapted to utilize the parasitic elements of the present invention through adaptation of the above described placement of parasitic elements by one of ordinary skill in the art.

Additionally, although the use of a ground plane has been disclosed herein, it shall be appreciated that the concepts of the present invention may be realized without a ground plane.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An antenna system comprising:

an array of antenna elements, said array of antenna elements comprise:

a plurality of active antenna elements disposed in a predetermined configuration, wherein said plurality of active antenna elements are said ones of said antenna elements coupled to said signal feed network; and a plurality of passive antenna elements disposed in a predetermined configuration, wherein said predetermined configuration of the parasitic antenna elements corresponds to said predetermined configuration of the active antenna elements to thereby provide substantially symmetric current distribution in said array of antenna elements; and a signal feed network coupled to ones of the antenna elements adapted to provide substantially different radiation patterns in the forward and reverse links.

2. The system of claim 1, wherein said signal feed network comprises:

a beam forming network associated with one of said forward and reverse links; and duplexer circuitry disposed between said coupled ones of said antenna elements and said beam forming network operable to arbitrate signals in said forward and reverse links.

3. The system of claim 1, wherein a difference in said substantially different radiation patterns in the forward and reverse links is beam width.

4. The system of claim 3, wherein antenna beams of one of said forward and reverse links are relatively narrow with respect to antenna beams of the other one of said forward and reverse links.

5. The system of claim 1, wherein a difference in said substantially different radiation patterns is an orientational configuration of antenna beams of said forward link and said reverse link.

6. The system of claim 5, wherein antenna beams of one of said forward and reverse links are provided in a same azimuthal orientation to provide communications within a substantially same area and antenna beams of the other one of said forward and reverse links are provided in different azimuthal orientations to provide communications within substantially non-overlapping areas.

7. The system of claim 1, wherein said plurality of active antenna elements are disposed in a plurality of exclusively active antenna element columns and said passive antenna elements are disposed in a plurality of exclusively passive antenna element columns.

8. The system of claim 7, wherein said plurality of active antenna element columns are disposed as inner columns of said antenna array and said plurality of passive antenna element columns are disposed as outer columns of said antenna array.

9. The system of claim 7, wherein said plurality of active antenna element columns comprises four active antenna element columns.

10. The system of claim 7, wherein said plurality of passive antenna element columns comprises four passive antenna element columns.

11. The system of claim 7, wherein a number of columns of both said plurality of active antenna element columns and said plurality of passive antenna element columns is the same.

12. The system of claim 7, wherein spacing between each antenna element column of said plurality of active antenna element columns and said plurality of passive antenna element columns is substantially the same.

13. An antenna system for providing multiple signals throughout a desired area comprising:

an array of antenna elements including a plurality of active antenna elements disposed in a predetermined configuration, and a plurality of parasitic antenna elements disposed in a predetermined configuration, wherein said predetermined configuration of the parasitic antenna elements corresponds to said predetermined configuration of the active antenna elements to thereby provide substantially symmetric current distribution in said array of antenna elements; and a signal feed network coupled to said active antenna elements having at least one signal interface associated with a first antenna beam configuration and at least one signal interface associated with a second antenna beam configuration, wherein a beam width of said first beam configuration is different from that of said second antenna beam configuration.

14. The system of claim 13, wherein said signal feed network is adapted to combine signals for radiation within antenna beams having said first antenna beam configuration and introducing a signal loss of less than 1 dB.

15. The system of claim 14, wherein said signal feed network comprises:

a plurality of diplexers each coupled to a different interface of said at least one signal interface associated with the first antenna beam configuration to combine two signals for radiation within antenna beams having said first antenna beam configuration.

16. The system of claim 15, wherein each antenna beam of said first antenna beam configuration is oriented substantially the same with respect to said antenna array.

17. The system of claim 13, wherein said first beam width is wider than 50 degrees and said second beam width is narrower than 50 degrees.

18. The system of claim 17, wherein said first beam width is approximately 100 degrees.

19. The system of claim 17, wherein said second beam width is approximately 30 degrees.

20. The system of claim 13, wherein said signal feed network is adapted to provide antenna beams having said first beam configuration in a first communication link direction and to provide antenna beams having said second beam configuration is a second communication link direction.

21. The system of claim 20, wherein said first communication link direction is a forward link and said second link direction is a reverse link.

22. The system of claim 20, further comprising a base transceiver station providing PCS communication services.

23. The system of claim 20, further comprising a base transceiver station providing cellular telephone services.

24. The system of claim 20, wherein said signal feed network comprises:

duplexer circuitry coupled to said active antenna elements and operable to arbitrate signals between said at least one signal interface associated with the first antenna beam configuration and said at least one signal interface associated with the second antenna beam configuration.

25. The system of claim 13, wherein said signal feed network is adapted to provide antenna beams having said first beam configuration to a first communication service and to provide antenna beams having said second beam configuration to a second communication service.

26. The system of claim 13, wherein said plurality of active antenna elements are disposed in a plurality of exclusively active antenna element columns and said parasitic antenna elements are disposed in a plurality of exclusively parasitic antenna element columns.

27. The system of claim 26, wherein said plurality of active antenna element columns are disposed as inner columns of said antenna array and said plurality of parasitic antenna element columns are disposed as outer columns of said antenna array.

28. The system of claim 26, wherein said plurality of active antenna element columns comprises four active antenna element columns.

29. The system of claim 26, wherein said plurality of parasitic antenna element columns comprises four parasitic antenna element columns.

30. The system of claim 26, wherein a number of columns of both said plurality of active antenna element columns and said plurality of parasitic antenna element columns is the same.

31. The system of claim 26, wherein spacing between each antenna element column of said plurality of active antenna element columns and said plurality of parasitic antenna element columns is substantially the same.

32. The system of claim 13, wherein said signal feed network comprises:

a beam forming network coupled to said at least one signal interface associated with the second antenna beam configuration.

33. The system of claim 32, wherein said beam forming network is adapted to provide multiple fixed narrow beams.

34. The system of claim 33, wherein said beam forming network is a Butler matrix.

35. The system of claim 32, wherein said beam forming network is an adaptive beam forming network.

36. An antenna method for providing radiation patterns having different characteristics in the forward and reverse wireless links, said method comprising the steps of:

deploying an array of antenna elements including a plurality of active antenna elements disposed in a predetermined configuration, and a plurality of parasitic antenna elements disposed in a predetermined configuration;

coupling a signal feed network to said active antenna elements of said array of antenna elements, wherein said signal feed network includes a beam forming matrix having a plurality of signal interfaces each associated with a reverse link antenna beam signal, and wherein said signal feed network includes a plurality of signal interfaces each associated with a forward link antenna beam signal; and operating said signal feed network to pass said reverse link signals through said beam forming matrix and to bypass said beam forming matrix with said forward link signals.

37. The method of claim 36, wherein said predetermined configuration of the parasitic antenna elements corresponds to said predetermined configuration of the active antenna elements to thereby provide substantially symmetric current distribution in said array of antenna elements.

38. The method of claim 36, further comprising the step of:

radiating all forward link signals of said antenna array within a substantially same service area.

39. The method of claim 38, further comprising the steps of:

combining ones of said forward link signals to thereby form a forward link antenna beam signal including a plurality of forward link signals; and coupling said forward link antenna beam signal including a plurality of forward link signals to a same signal interface of said plurality of signal interfaces associated with forward link antenna beam signals.

40. The method of claim 39, wherein said combining step comprises the use of a diplexer to combine two forward link signals.

41. The method of claim 36, wherein a characteristic of radiation patterns of said forward link is a beam width of approximately 100 degrees.

42. The method of claim 41, wherein a characteristic of radiation patterns of said reverse link is a beam width of approximately 30 degrees.

43. The method of claim 42, wherein a characteristic of radiation patterns of said reverse link is each of said reverse link beams having a substantially non-overlapping azimuthal orientation.

44. The method of claim 36, wherein a characteristic of radiation patterns of said forward link is each of said forward link beams having substantially a same azimuthal orientation.

45. The method of claim 36, wherein said step of deploying an array of antenna elements comprises the steps of:

disposing said plurality of active antenna elements in a plurality of exclusively active antenna element columns; and disposing said parasitic antenna elements in a plurality of exclusively parasitic antenna element columns.

46. The method of claim 45, wherein said plurality of active antenna element columns are disposed as inner columns of said antenna array and said plurality of parasitic antenna element columns are disposed as outer columns of said antenna array.

47. The method of claim 45, wherein said plurality of active antenna element columns comprises four active antenna element columns.

48. The method of claim 45, wherein said plurality of parasitic antenna element columns comprises four parasitic antenna element columns.

49. The method of claim 45, wherein a number of columns of both said plurality of active antenna element columns and said plurality of parasitic antenna element columns is the same.

50. The method of claim 45, wherein spacing between each antenna element column of said plurality of active antenna element columns and said plurality of parasitic antenna element columns is substantially the same.

51. The method of claim 36, wherein said beam forming matrix is adapted to provide multiple fixed narrow beams.

52. The method of claim 51, wherein said beam forming matrix is a Butler matrix.

53. The method of claim 36, wherein said beam forming matrix is an adaptive beam forming network.

* * * * *

UNITED STATES PATENT AND TRADEMARK OFFICE

CERTIFICATE OF CORRECTION

PATENT NO. : 6,317,100 B1
DATED : November 13, 2001
INVENTOR(S) : J. T. Elson et al.

It is certified that error appears in the above-identified patent and that said Letters Patent is hereby corrected as shown below:

Column 7,
Line 41, delete "1" and insert -- ℓ -- therefor.
Line 47, delete "1" and insert -- ℓ -- therefor.

Column 8,
Line 29, delete "1" and insert -- ℓ -- therefor.
Line 38, delete "1" and insert -- ℓ -- therefor.

Signed and Sealed this

Twenty-third Day of April, 2002

*Attest:*

*Attesting Officer*

JAMES E. ROGAN
*Director of the United States Patent and Trademark Office*